US011077975B1

(12) United States Patent
Shipman

(10) Patent No.: US 11,077,975 B1
(45) Date of Patent: Aug. 3, 2021

(54) BUNDLE TIE TOOL

(71) Applicant: Barry Shipman, St. Croix, VI (US)

(72) Inventor: Barry Shipman, St. Croix, VI (US)

( * ) Notice: Subject to any disclaimer, the term of this patent is extended or adjusted under 35 U.S.C. 154(b) by 0 days.

(21) Appl. No.: 17/219,274

(22) Filed: Mar. 31, 2021

Related U.S. Application Data

(60) Provisional application No. 63/007,090, filed on Apr. 8, 2020.

(51) Int. Cl.

| | |
|---|---|
| ***B65B 13/02*** | (2006.01) |
| ***B65B 61/00*** | (2006.01) |
| ***B65B 13/22*** | (2006.01) |
| ***B26D 7/14*** | (2006.01) |

(52) U.S. Cl.
CPC ..... *B65B 61/005* (2013.01); *B26D 7/14* (2013.01); *B65B 13/027* (2013.01); *B65B 13/22* (2013.01)

(58) Field of Classification Search
CPC ..... B65B 13/02; B65B 13/025; B65B 13/027; B65B 13/22; B65B 61/005; B65B 13/18; B65B 13/24; B65B 13/34; B65B 13/345; B26D 7/14; B26D 1/48; B26D 7/08; Y10T 24/1498; Y10T 83/42; Y10T 83/404; Y10T 83/416; H02G 1/005; F16B 37/002
USPC ..... 140/57, 93 A, 93.2, 117, 123, 123.5, 140/123.6, 139; 30/240; 411/14.5, 432, 411/917; 83/199, 200
See application file for complete search history.

(56) References Cited

U.S. PATENT DOCUMENTS

| | | | | |
|---|---|---|---|---|
| 3,014,506 A | | 12/1961 | Crimmins et al. | |
| 3,254,680 A | | 6/1966 | Caveney et al. | |
| 3,841,371 A | * | 10/1974 | Thurston | F16B 39/284 411/276 |
| 4,647,883 A | * | 3/1987 | Oxley | F16B 19/02 333/232 |

(Continued)

FOREIGN PATENT DOCUMENTS

| | | | |
|---|---|---|---|
| CN | 208825574 U | * | 5/2019 |
| CN | 211680166 U | * | 10/2020 |

(Continued)

OTHER PUBLICATIONS

GLOBALIndustrial.com, "Bags & Sealers—Bag Sealer—Tension Tool Cable Tie Tension Tool-B450017", https://www.globalindustrial.com/p/packaging/bags/bag-sealer/tach-it-tension-tool-cable-tie-tension-tool?infoParam.campaignId=T9F&gclid=EAIaIQobChMI7L; retrieved from Internet on Feb. 12, 2020.

*Primary Examiner* — Shelley M Self
*Assistant Examiner* — Jared O Brown
(74) *Attorney, Agent, or Firm* — St. Onge Steward Johnston and Reens

(57) ABSTRACT

A cable tie cut off tool including two elements. A first element has a through hole and internal and external threads, the internal threads being configured in a direction opposite the external threads. A second element includes a through hole with a blade at one end of the through hole and the through hole being threaded with internal threads which mate the external threads of the first element. A keyway is in the internal threads of the first element. The internal threads of the first element are designed to cut into but not all the way through a cable tie end to allow the first element to tension the cable tie and then the first and second elements to be rotated together to engage the blade and cut off the tail of the cable tie.

18 Claims, 7 Drawing Sheets

(56) References Cited

U.S. PATENT DOCUMENTS

| | | | | | |
|---|---|---|---|---|---|
| 5,066,180 | A | * | 11/1991 | Lang | F16B 37/122 411/103 |
| 5,303,718 | A | * | 4/1994 | Krajicek | A61B 17/686 128/897 |
| 5,597,018 | A | * | 1/1997 | Shipman | B65B 13/027 140/123.6 |
| 5,628,348 | A | * | 5/1997 | Scott | B65B 13/027 140/123.5 |
| 6,701,579 | B1 | | 3/2004 | De La Pena Razquin | |
| 7,360,281 | B1 | | 4/2008 | MacCartey et al. | |
| 9,394,067 | B2 | | 7/2016 | Dyer | |
| 10,343,799 | B2 | | 7/2019 | Thomas et al. | |
| 2013/0192710 | A1 | | 8/2013 | Guerrero | |
| 2018/0064473 | A1 | * | 3/2018 | Karadeniz | A61B 17/8861 |

FOREIGN PATENT DOCUMENTS

| | | | | |
|---|---|---|---|---|
| CN | 212123370 | U | * | 12/2020 |
| KR | 20130138995 | A | * | 12/2013 |

* cited by examiner

BUNDLE TIE TOOL

FIELD OF THE INVENTION

The following relates to a bundle tie cutoff tool. More particularly, the tool provides a compact, convenient and inexpensive way to cleanly cut off excess ends from bundle ties which are commonly referred to as zip ties or cable ties.

BACKGROUND OF THE INVENTION

Bundle ties or zip ties are a convenient way to organize cabling, prepare wiring harnesses and generally hold things in place or tie them together. However, the excess tail end can become unsightly or may obstruct or otherwise get in the way of other items. Therefore, it is desirable to cut off these tails which is sometimes done with scissors or other cutting tools. However, sometimes these cutting tools are not immediately available to the user who just purchased a package of bundle/cable ties or the tools may not provide repeatable, clean cuts. In addition, the blades of scissors or wire cutters can often be longer than the actual cable tie is wide, thus leading to the possibility that something will mistakenly be caught in the blades during cutting by mistake.

It is desirable to provide a small and easy to use and simple cutting tool which provides a clean and repeatable cut off edge. It is further desirable that this tool cuts without leaving sharp cut off ends which could damage other adjacent items to the bundle or zip tie over time or cause injury, for example, cuts to persons reaching into tight spaces where these zip ties have been improperly cut.

The present inventor is also the inventor of U.S. Pat. No. 5,597,018 and an improved tool compared to that patent is described herein. There are a number of differences relative to that prior patent including but not limited to the stop head (31) is eliminated and so is the stop assembly (80). As shown in the present disclosure for the present invention, holding the excess tail in tension during the cutting blade engagement allows elasticity to withdraw the excess flush with the head. Carry through of this tail/cut off using a traditional blade without tension as shown in the present invention may result in unintended damage to surrounding items, especially in confined locations. The present invention solves this problem among others.

SUMMARY OF THE INVENTION

Therefore, it is an object of the present invention to provide a simple to use, inexpensive and compact cut off tool which provides clean and reliable cuts.

It is a further object of the invention to provide the tool in a kit with appropriately sized zip ties.

It is yet another object of the invention to provide a bundle tie cutting tool which inhibits and/or lessens the risk of unintentional cutting of items adjacent the tie which is intended to be cut.

The term "crest" refers to the location on the threads which is a maximum diameter for external (male) threads or the location on the threads which is a minimum diameter for internal (female) threads. The term "root" refers to the location on the threads which is a minimum diameter for external (male) threads or the location on the threads which is a maximum diameter for internal (female) threads.

The terms "first" and "second" are used to distinguish one element, set, data, object or thing from another, and are not used to designate relative position or arrangement in time.

These stated objects and other objects are achieved by providing a cable tie cut off tool with first and second elements. The first element has a through hole and internal and external threads, the internal threads being configured in a direction opposite the external threads. The second element includes a through hole with a blade at one end of the through hole and the through hole being threaded with internal threads which mate the external threads of the first element. A keyway is in the internal threads of the first element. The internal threads have a sharpened edge arranged along a path generally oriented from the base of the keyway towards a central axis of the first element.

Other objects are achieved by providing a method of operating a cable tie cutoff tool is provided including one or more of the steps of: (1) providing a tool including: a first element with a through hole and internal and external threads, the internal threads being configured in a direction opposite the external threads; a second element including a through hole with a blade at one end of the through hole and the through hole being threaded with internal threads which mate the external threads of the first element; and a keyway in the internal threads of the first element; (2) Inserting a cable tie through the through hole of the second element at the blade end such that the cable tie passes through the first and second element; (3) rotating the first element in a first rotation direction relative the second element such that the first and second elements move apart from each other and causes the sharpened edge to cut into the cable tie and tension the cable tie; (4) next, rotating the first and second elements together in a second rotation direction such that the blade engages the cable tie and cuts off the cable tie.

Other objects are achieved by providing a method of cutting a cable tie including the steps of: providing a tool including: first element with a through hole and internal and external threads, the internal threads being in a first direction and the external threads being in a second direction; a second element including a through hole with a blade at one end of the through hole and the through hole being threaded with internal threads which mate the external threads of the first element; and a keyway in the internal threads of the first element; inserting a cable tie through the through hole of the second element at the blade end such that the cable tie passes through the first and second element; rotating the first element 180 degrees or less in a rotation direction relative the second element such that the first and second elements move apart from each other and causes the internal threads at the keyway to cut into the cable tie and tension the cable tie; next, rotating the first and second elements together such that the blade engages the cable tie and cuts off the cable tie. In certain aspects the internal threads of the first element are right hand threads and the external threads of the first element are left hand threads.

Other objects are achieved by providing a cable tie cut off kit including a bag containing a tool and cable ties. The tool includes a first element with a through hole and internal and external threads, the internal threads being configured in a direction opposite the external threads; a second element including a through hole with a blade at one end of the through hole and the through hole being threaded with internal threads which mate the external threads of the first element; and a keyway in the internal threads of the first element. A plurality of cable ties are provided and the bag contains the plurality of cable ties and the tool. In certain embodiments, the bag is closed around a majority of its perimeter. In certain aspects the bag includes a re-sealable closure.

In certain aspects a first width corresponds to a width of the cable ties and a second width corresponds to a distance from the base of the keyway across the through hole, through center thereof and to the inside edge of the internal threads, the second width equal to or greater than the first width. In certain aspects the second width is no greater than a sum of the first width plus a distance from a crest to root of the internal threads. In certain aspects the internal threads have a sharpened edge arranged along a path generally oriented from the base of the keyway towards a central axis of the first element.

Other objects are achieved by providing a cable cut off tool including first and second elements. The first element has a through hole and internal and external threads, the internal threads being in a right hand direction and the external threads being in a left hand direction. The second element includes a through hole with a blade at one end of the through hole and the through hole being threaded with internal threads which mate the external threads of the first element. A keyway is provided in the internal threads of the first element.

In certain aspects the internal threads have a sharpened edge arranged along a path generally oriented from the base of the keyway towards a central axis of the first element Other objects are achieved by providing a method of cutting a cable tie including one or more of the steps of: (1) providing a tool including: first element with a through hole and internal and external threads, the internal threads being in a right hand direction and the external threads being in a left hand direction; a second element including a through hole with a blade at one end of the through hole and the through hole being threaded with internal threads which mate the external threads of the first element; and a keyway in the internal threads of the first element, the internal threads having a sharpened edge arranged along a path generally oriented from the base of the keyway towards a central axis of the first element; (2) inserting a cable tie through the through hole of the second element at the blade end such that the cable tie passes through the first and second element; (3) rotating the first element in a right rotation direction relative the second element such that the first and second elements move apart from each other and causes the sharpened edge to cut into the cable tie and tension the cable tie; (4) next, rotating the first and second elements together in a left rotation direction such that the blade engages the cable tie and cuts off the cable tie.

Other objects are achieved by providing a cable tie cut off tool with first and second elements. The first element has a through hole and internal and external threads. The internal threads are configured in a direction opposite the external threads. The second element includes a through hole with a blade at one end of the through hole and the through hole being threaded with internal threads which mate the external threads of the first element. A keyway is in the internal threads of the first element.

Other objects are achieved by providing a cable tie cut off kit which includes the tool with the first and second elements and a plurality of cable ties in a bag. Preferably a first width corresponds to a width of the cable ties and a second width corresponds to a distance from the base of the keyway across the through hole, through center thereof and to an inside edge of the internal threads, the second width equal to or greater than the first width. Even more preferably, the second width is no greater than a sum of the first width plus a distance from a crest to root of the internal threads.

Other objects are achieved by the tool being provided and consisting essentially of the first and second element. This first and second element may comprise the various features of the tool described herein and importantly, in this embodiment, the tool is only those two essential parts.

In certain aspects the internal threads include a cutaway section adjacent the keyway, the cutaway section configured to engage the cable tie to cause the internal threads to cut into the cable tie when the first element is rotated relative to the second element to cause the first and second elements to move apart. In other aspects the blade includes two blade sections on opposite sides of an end opening of the second element. In other aspects each blade section is positioned opposite a non-blade section such that rotation of the first section in a first direction engages the blade with a work piece extending through the end opening and rotation of the first section in a second direction causes the work piece to contact the non-blade sections without being cut. In other aspects the blade defines an end opening of the through hole of the second element and the end opening is rectilinear in shape. In still other aspects the cutaway section creates a sharpened edge adjacent to the keyway and the cutaway section is configured to cut into the cable tie when the first element is rotated relative to the second element to cause the first and second elements to move apart.

Other objects of the invention and its particular features and advantages will become more apparent from consideration of the following drawings and accompanying detailed description.

DETAILED DESCRIPTION OF THE INVENTION

Figure 1:
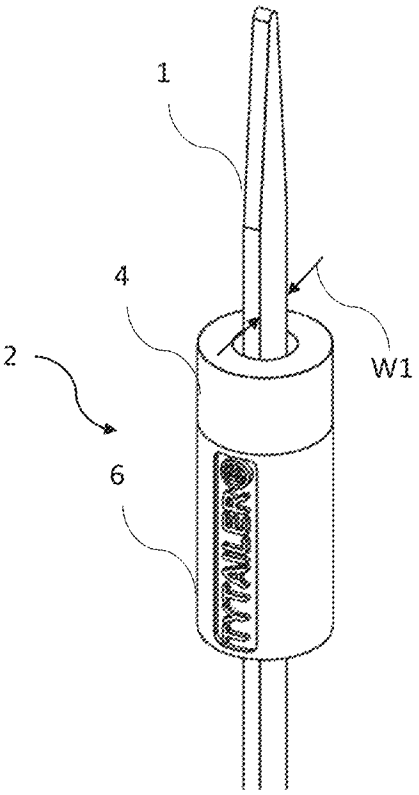
FIG. 1 is a perspective view of the tool with a bundle or zip tie tail therein.
Figure 2:
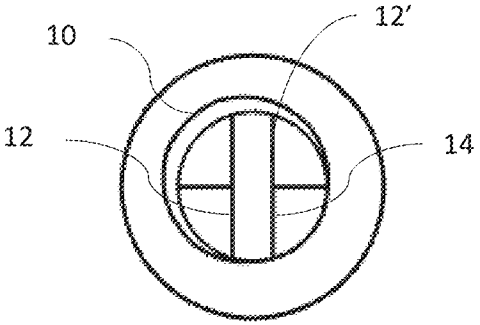
FIG. 2 is top view of one part of FIG. 1.
Figure 3:
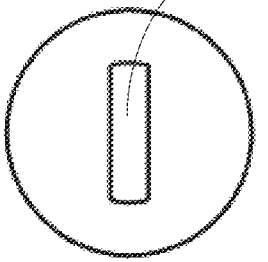
FIG. 3 is bottom view of FIG. 2.
Figure 4:
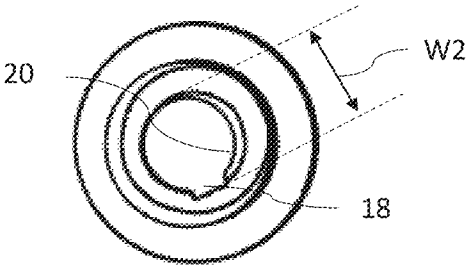
FIG. 4 is a bottom view of a second part of FIG. 1.
Figure 5:
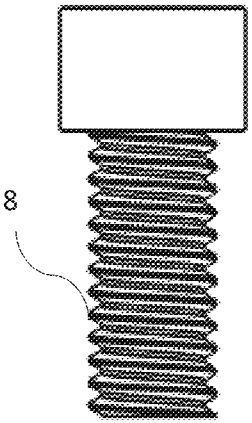
FIG. 5 is a side view of FIG. 4.

Referring now to the drawings, wherein like reference numerals designate corresponding structure throughout the views. The following examples are presented to further illustrate and explain the present invention and should not be taken as limiting in any regard.

Figure 7:
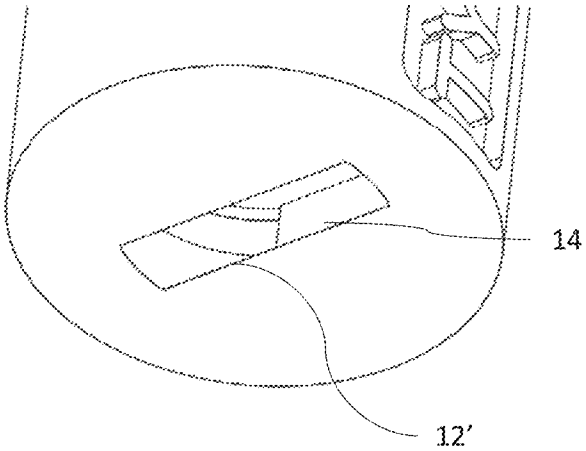
FIG. 7 is a detail perspective view of the part shown in FIGS. 2-3.

As shown in FIGS. 1-5, the bundle tie 1 (sometimes referred as zip tie or cable tie) is inserted into the tool 2. The tool essentially includes two parts with various features as described herein. The first part 4 is sometimes referred to as the tensioning element or part and the second part 6 is sometimes referred to as the cutting part. The tensioning part 4 (FIG. 4-5) has external threads 8 which are threaded in a first direction (e.g. left hand threads in this instance). The cutting part 6 includes female threads 10 also in the first direction which allow threads 8 to screw into those female threads 10. Cutting part 6 includes blade elements 12/12' which are sharpened such that counter clockwise (left) turning from the view of FIG. 2 can cut the bundle tie tail 1. Opposite the blade elements 12/12' and across the opening 16 are blunt ends 14 which inhibit cutting when the tool is turned clockwise (right) from the view of FIG. 2. FIG. 7 shows additional detail on the blades and blunt elements.

Figure 11:
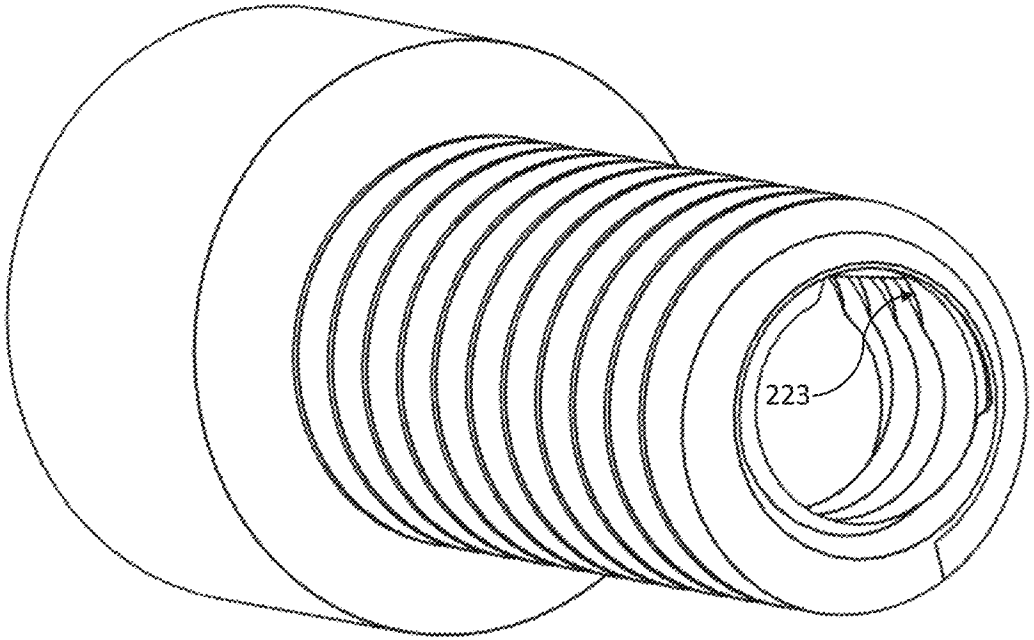
FIG. 11 shows FIG. 6 from a perspective view.
Figure 12C:
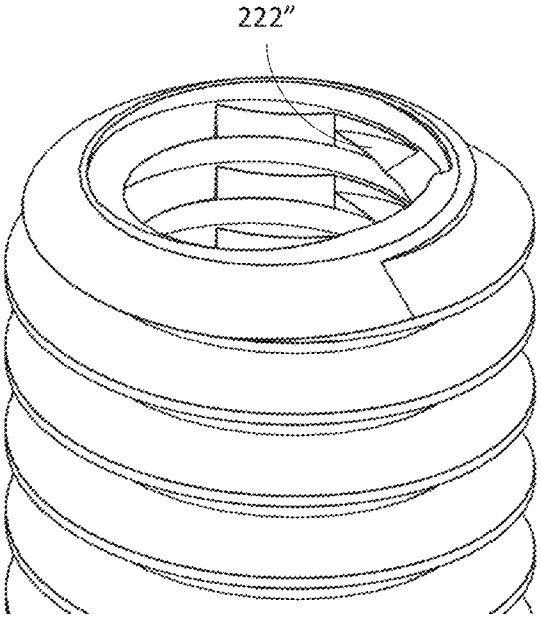
FIG. 12C is a perspective view of the embodiment of FIGS. 12A and 12B
Figure 12B:
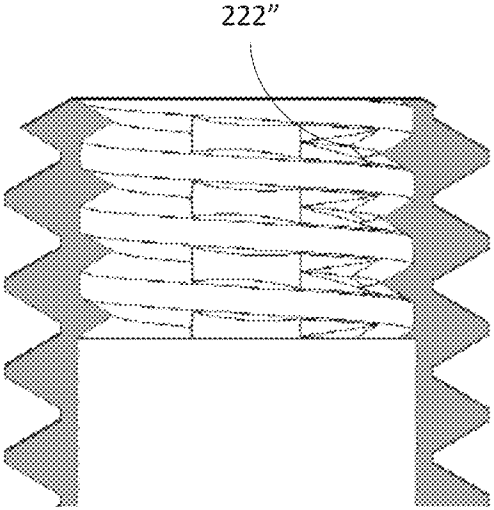
FIGS. 12A and 12B are section and detail section views of another embodiment of the internal cutting thread for the tool of FIG. 1
Figure 12A:
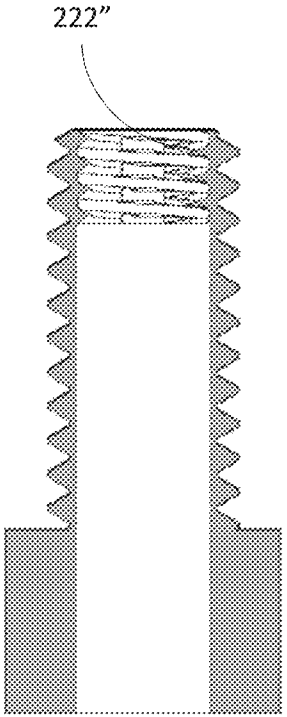

The tensioning element 4 includes internal threads 20 which are in a second direction (right hand) and also include a keyway. The distance from the base of the keyway all the way across the hole (through center) to the threads 20 is sized so that the tail 1 at its widest point can fit in through opening 16 and through the hole as shown in FIG. 1. The threads adjacent the keyway 18 are sharpened which may create an edge generally radially oriented or inwardly oriented. One example of a sharpened thread is found in FIGS. 12A-C. These internal threads 20 are only located on part of the through hole in the tensioning part, specifically, FIG. 11 shows 4 threads with the remainder of the through hole in the tensioning part being provided without threads, specifically having a diameter larger than the diameter of the internal threads at the crest, more particularly equal or about equal to the diameter of the threads at the root. In this way, the tail of the cable tie will be able to pass through the keyway 18 and the tensioning part's through hole and not be impeded from doing so by the area of the tensioning part behind the threads (i.e. closer to the user). Thus, preferably, the internal threads of the tensioning part extend along less than the full length of the through hole in which the threads are located. Preferably the keyway extends through 2-8 threads, more preferably 2-6 threads and even more preferably 3-5 threads. Alignment of the keyway with opening 16 is accomplished by fully threading/screwing together or fully assembling the two halves. As an alternative to sharpened threads, ramps 223 (FIG. 11) may be provided to take advantage of the thread pattern being sharp and thus the ramp directs the tie end to engage with those threads opposite the ramp.

Figure 6:
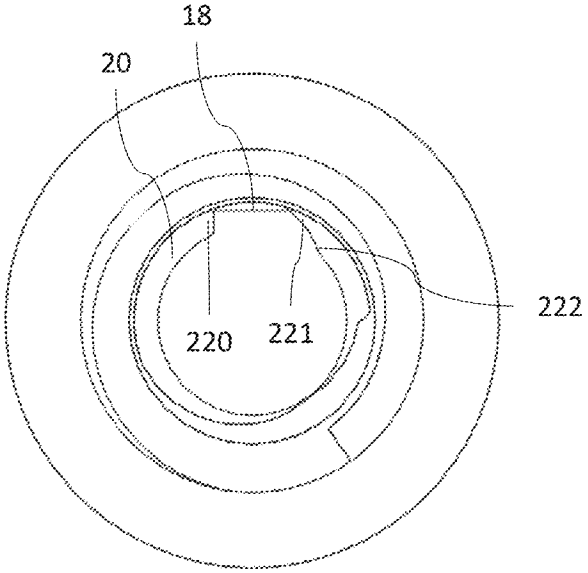
FIG. 6 is a detail perspective view of an embodiment of the part shown in FIGS. 4-5.

In preferred embodiments, only one side of the threads adjacent the keyway 18 are sharpened and the side sharpened is dependent on the threading direction. In the case where the threads 20 are right hand and the threads 8 are left hand, the right side of the keyway 18 is sharpened 22 (from the view of the user looking from the side where "1" is shown on the tail, e.g. the top view). In preferred embodiments, the sharpened 22 edge is aligned within 0-45 degrees, more particularly 0-25 degrees off a radial line from the center of the hole of the threads 20 to the base of the sharpened 22 edge. In another embodiment shown in FIG. 6, the keyway is shaped with a steeper transition 220 on one side with a more gradual transition 221 between keyway and threads on the other side, with an approximate or average angle relative to the radial line greater than 45 degrees, more particularly greater than 60 degrees. The result is that a more gradual approach to the thread point 222 is created. The result of this gradual transition 221 is the creation of a ramp with a flat surface 223 for the cable tie tail to move up. As the tail moves up this ramp when the tensioning part is rotated relative the cutting part, the tail is forced against the internal threads opposite the keyway/transition 221. These threads cut into the tail and engage it such that the tail is pulled in tension as the tensioning and cutting halves of the tool move apart. FIG. 11 shows another way in which the internal threads can cut into the tail. Specifically, a lead thread is cut into each of the internal threads. As another alternative, a combination of sharpened threads and a thread pattern which is not ACME or is a thread pattern with a sharp crest of the thread can be used. The sharpened edge can also be made to be more gradual similar to the slope/shape as viewed from FIG. 6, but sharpened along the center line of the thread or across the centerline of the thread to create a gradual engagement of the sharpened edge with the tail of the cable tie. In this manner this shallow transition 221 is sharpened to a point such that the transition 221 itself creates a sharpened edge which cuts into the tail of the cable tie. One example of a sharpened thread of a non ACME type is in FIGS. 12A-C. This sharpened thread 222" provides for gradual cutting into the tail. This sharpened thread 222" is very similar to what is commonly referred to as a "lead thread" which would be found in a nut or bolt. However, each of the threads as shown being cut off by the keyway is a "lead thread" or there are e.g. two or more lead threads, preferably 3 or 4 lead threads.

Thus, these various configurations of sharpened threads/ramps provide a cutaway section in the internal threads that assists in these threads engaging and cutting into the tail of the cable tie to hold tension on the cable tie. It is understood that the internal threads cutting into the cable tie could be, for example, the cutaway section cutting in, threads opposite the cutaway cutting in, and the threads in the area after the thread point 222 cutting in as well as combinations thereof. This cutting in does not go all the way through the tail as the cutting in by the threads allows for tension to be applied to the cable/zip tie. With the tension held, the blade can more easily cut off the cable tie at the right location.

Regardless of how the tail is engaged by the internal threads, the result is that the combination of the different direction threading allows the user to install the bundle tie 1 and feed it through the opening 16 as shown in FIG. 1. With the tool up against the bundle tie stop (i.e. the square head of the tie), the user holds the cutting element 6 in place and rotates the tensioning element 4 relative to the cutting element 6. During this rotation, the threads 20 will cut into the tail of the tie. Since the threads 8/10 are left hand, right rotation will cause the tensioning part 4 to move out of the cutting part 6 slightly. Since the threads 20 are simultaneously cutting into the cable tie, the separating action will place the tie end under tension. After less than a half (180 deg) rotation of tension part 4, there is now sufficient tension on the tie end. The user then holds both the tension part 4 and the cutting part 6 together and rotates them to the left (from the view of FIG. 2), which causes blades 12/12' to engage the tie end and cut it off. The tension held by threads 20 enables the blades 12/12' to provide a clean cutoff tail of the tie 1.

In one preferred embodiment, the tool is provided in a kit of ties. Specifically, the ties of a given width are matched to an appropriately sized tool. The distance across the through hole in the tensioning element between the keyway and the crest of an opposite thread (measured through center) is matched with the width. This distance across W2 is equal to or slightly larger than the tail width W1, preferably in a range from 0%-10% larger and more preferably in a range of 0%-5% larger and even more particularly 0%-2.5% or even more preferably 0%-1.5% larger. However, distance W2 will not be larger than the sum of W1 plus the measurement from crest to root of the internal threads 20 as in this situation, the threads would not cut into the tail 1 during the tightening process.

Figure 8:
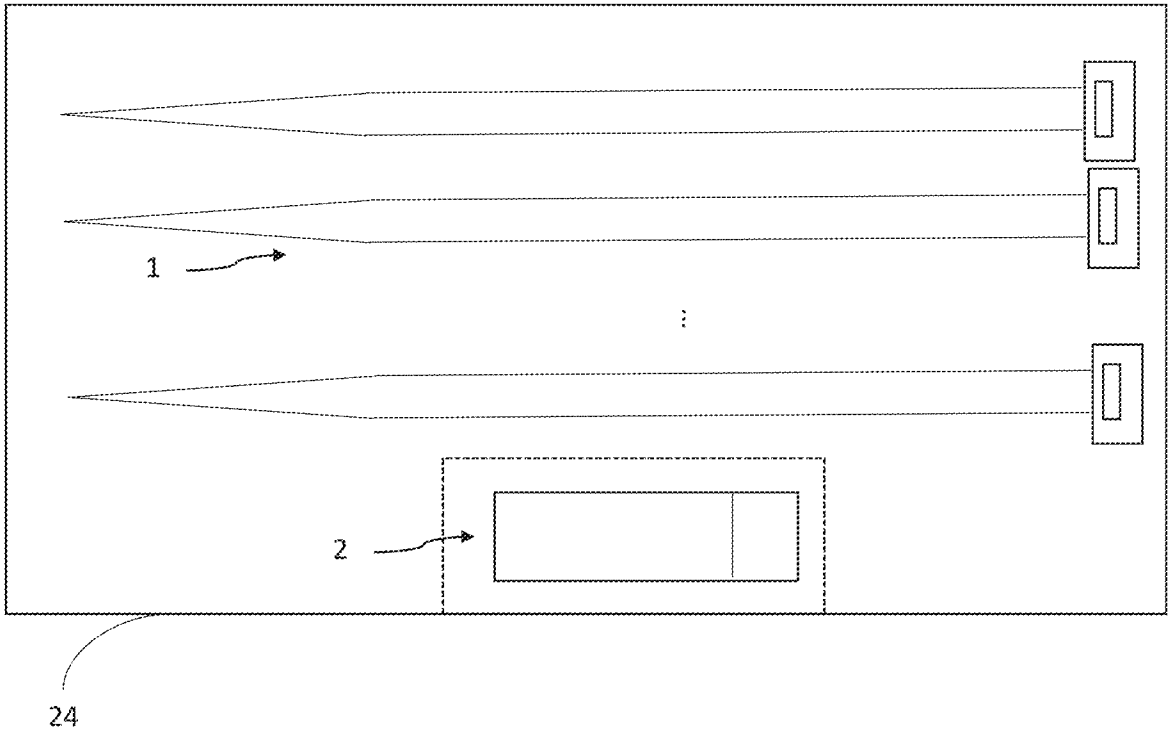
FIG. 8 shows a kit of multiple ties and including the tool according to FIG. 1.

FIG. 8 shows one such embodiment of a kit where a number of ties 1 are in a bag with a tool 2 sized appropriately and all of the foregoing are contained in a bag 24. The bag is preferably a plastic bag which is sealed around/adjacent its peripheral edges. Optionally, the plastic bag is a thermoplastic film and a seal (dashed line) is used to hold the tool 2 in a particular location or area in the bag 24. In preferred embodiments, there are at least 20 ties in the bag, and more preferably at least 50. The tool is sized to cut the ties that are in the bag with the tool. It is contemplated that multiple tools can be provided along with multiple sizes of cable ties, with each tool sized to one of the cable tie sizes.

Figure 10B:
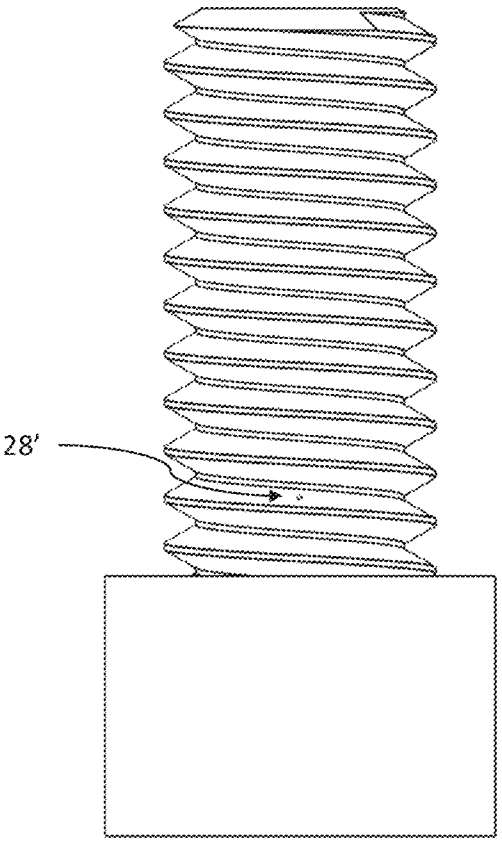
FIGS. 10A and 10B show additional features of the tensioning part of FIG. 1.
Figure 10A:
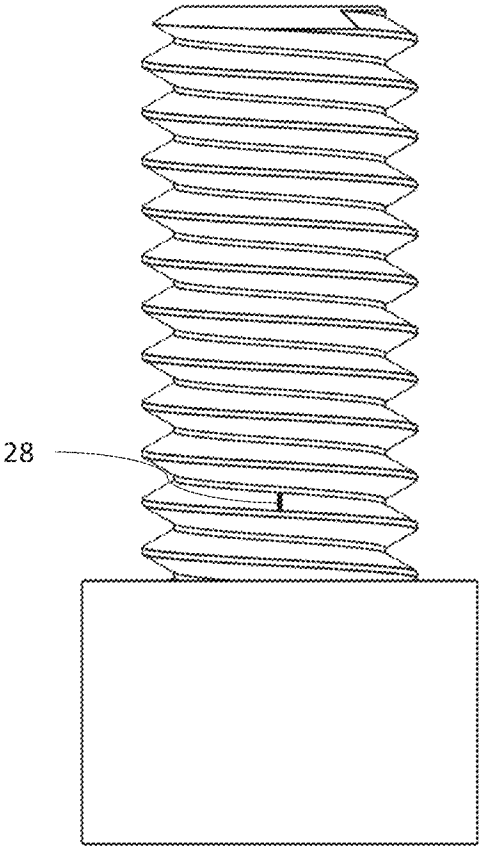
Figure 9:
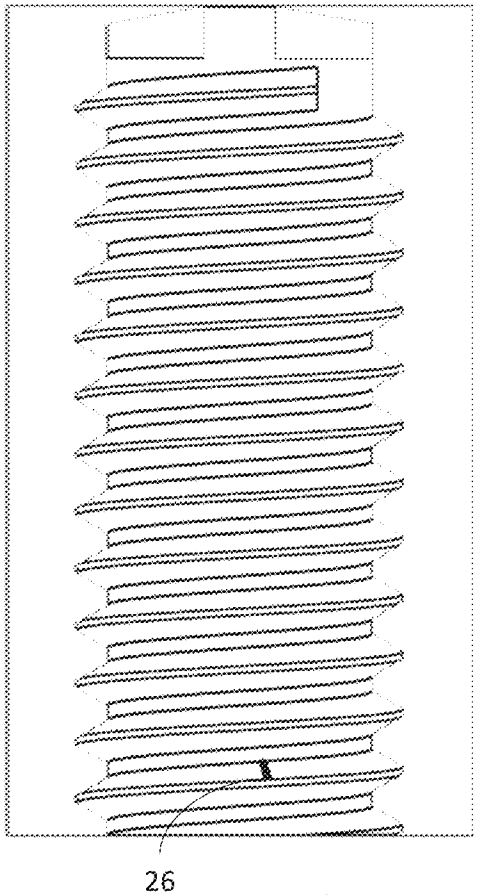
FIG. 9 shows a cross section of the cutting part of the tool according to FIG. 1.

FIG. 9 shows a cross section of the second part 6 or cutting part. Recess 26 is located in the internal threads as shown. This acts as a catch or stop or detent that receives protrusion 28 or 28' (FIGS. 10A/B) to allow the user to determine when the first and second elements have been rotated enough relative to each other to create sufficient tension. Once the interface between recess and protrusion is made, the user can then know from feel to rotate both parts together to engage the blade against the tail of the cable tie. Also, the user can let go and reposition their grip without losing tension to then be able to twist both parts together to cut the tail off. Although the protrusion is shown on the first part and the recess on the second, it is contemplated that this configuration can be reversed. The location of the two relative to each other is designed to allow the first part to be rotated a little less than a half rotation or less than 180 degrees relative to the second. Particularly, less than 175 or 170 or even less than 160 degrees, but typically more than 20 degrees, more preferably more than 30 degrees and even more preferably more than 45 degrees. This limitation of rotation or prevention of over rotation stops the tail from becoming un-threaded or un-engaged from the internal threads. Specifically, when the tail is cut into by the internal threads, if rotation proceeds around such that this cut section aligns through a radial line also aligned with the key way, the cable tie tail can shift towards the key way and out of engagement with the threads, causing tension to be lost.

The protrusion/recess combination creates a locking detent configuration. Since the protrusion/recess are located on the mating jacking faces of the threads which will bear against each other when tension is applied to the cable tie, the protrusion/recess will be better held in place by this tension. Furthermore, since the protrusion sticks out into the interface between the external threads of the tensioning part and the internal threads of the cutting part, the thread design is such that it is a little loose—loose enough so that the tool can turn relatively easily given that the protrusion would act somewhat like a grain of sand in the threads if the threads did not have a loose enough tolerance to allow for the protrusion to move through where no recess is located. Then, once the protrusion comes along the recess, the tension will pull the protrusion into that recess and hold it in place. In this manner, the user knows the appropriate amount of tension is achieved and loosening or repositioning one's grip will not result in loss of that tension. With tension held the two parts can be rotated together to engage the blade and cut off the cable tie tail.

Figure 13:
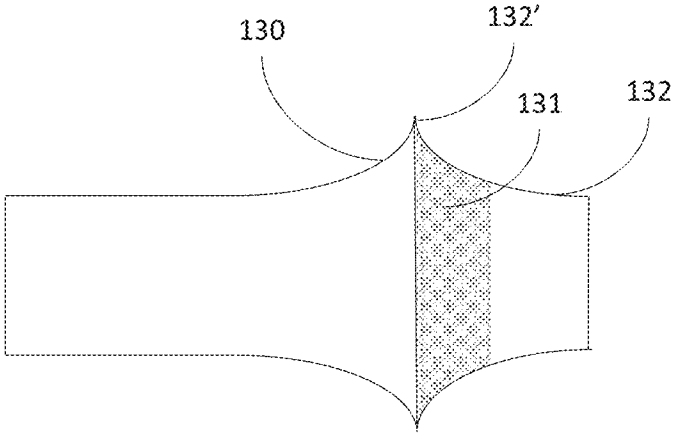
FIG. 13 shows an alternate shape for the tool of FIG. 1.

FIG. 13 shows an alternate shape for the tool. Instead of the cylindrical shape shown in FIG. 1, the tool has a combined cylindrical and bell shape with the tensioning and cutting halves meeting with two facing bell or trumpet shaped (130/132) areas. These trumpet shaped areas can also have knurled surfaces 131 or other texture such as scoring, milling, crenellated or corrugated or others which assists the user in gripping the part(s) and rotating them as needed to operate the tool, or they may be smooth. FIG. 13 shows an embodiment where one side is textured and the other side is not, however, combinations of one or the other being textured or not or both being textured or not is contemplated. This texture/scoring/knurling can be also present on the edges/ends of the trumpet to further assist in gripping both parts when they have been moved apart to create tension on the tie. This knurled/textured surface can also be used on the cylindrical embodiment. The shape and texture are especially useful in tight spaces where the user may have difficulty seeing the tool or cable tie, thus the tool allows for cutting of the cable tie by feel only and at the same time avoids unintentional cutting of items near the cable tie. Furthermore, the edges 132' or ends of the 'trumpet' shape of either or both parts may be milled, crenellated, corrugated or otherwise textured. For example, like the edge of a quarter. This facilitates better grip, especially with greasy or oily hands.

In preferred embodiments, the tool is manufactured using injection molding, preferably with minimal post molding processing. Preferably, features such as the internal/external threads, the keyway, the blades and the cutaway/sharpened edges are included in the molding process. It is contemplated that post molding processing may be needed, for example sharpening of the blades and/or some machining of the cutaway or the sharpened threads/ramps. The construction, assembly and operation of the tool is simple, in a preferred embodiment, the two parts are injection molded with minimal post molding machining required and therefore only the two parts are needed. However, it is contemplated that portions may be added to the injection molded parts after in some embodiments, for example the blades could be attached to the injection molded parts in post processing. It is also contemplated that the blades may be molded into the part as it is manufactured, e.g. the blades or the end with the blades could be made of a different material than the injection molded plastic, for example a metal, ceramic or other material capable of developing a sharp enough edge to cut the tie end.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A cable tie cutoff tool for cutting a cable tie comprising:

a first element with a through hole and internal and external threads, the internal threads being configured in a direction opposite the external threads;

a second element including a through hole with a blade at one end of the through hole of the second element and the through hole of the second element being threaded with internal threads which mate the external threads of the first element;

a keyway in the internal threads of the first element.

2. The tool of claim 1 wherein the internal threads of the first element include a cutaway section adjacent the keyway, the cutaway section configured to engage the cable tie to cause the internal threads of the first element to cut into the cable tie when the first element is rotated relative to the second element to cause the first and second elements to move apart.

3. The tool of claim 1 wherein the blade includes two blade sections on opposite sides of an end opening of the first element.

4. The tool of claim 3 wherein each blade section is positioned opposite a non-blade section such that rotation of the first section in a first direction engages the blade with a work piece extending through the end opening and rotation of the first section in a second direction causes the work piece to contact the non-blade sections without being cut.

5. The tool of claim 1 wherein the blade defines an end opening of the through hole of the second element and the end opening is rectilinear in shape.

6. The tool of claim 1 wherein a cutaway section creates a sharpened edge adjacent to the keyway and the cutaway section is configured to cut into the cable tie when the first element is rotated relative to the second element to cause the first and second elements to move apart.

7. A cable tie cut off kit comprising:

a tool including: a first element with a through hole and internal and external threads, the internal threads being configured in a direction opposite the external threads; a second element including a through hole with a blade at one end of the through hole of the second element and the through hole of the second element being threaded with internal threads which mate the external threads of the first element; and a keyway in the internal threads of the first element;

a plurality of cable ties; and a bag containing the plurality of cable ties and the tool.

8. The kit of claim 7 wherein a first width corresponds to a width of the cable ties and a second width corresponds to a distance from a base of the keyway across the through hole of the first element, through center thereof and to an inside edge of the internal threads of the first element, the second width is equal to or greater than the first width.

9. The kit of claim 8 wherein the second width is no greater than a sum of the first width plus a distance from a crest to root of the internal threads of the first element.

10. The kit of claim 7 further comprising the internal threads of the first element including a cutaway section adjacent the keyway, the cutaway section configured to engage one of the plurality of cable ties to cause the internal threads of the first element to cut into the cable tie when the first element is rotated relative to the second element to cause the first and second elements to move apart.

11. The tool of claim 7 wherein the blade includes two blade sections on opposite sides of an end opening of the first element.

12. The tool of claim 11 wherein each blade section is positioned opposite a non-blade section such that rotation of the first section in a first direction engages the blade with a cable tie of the plurality of cable ties extending through the end opening and rotation of the first section in a second direction causes the cable tie of the plurality of cable ties to contact the non-blade sections without being cut.

13. The tool of claim 7 wherein the blade defines an end opening of the through hole of the second element and the end opening is rectilinear in shape.

14. The tool of claim 10 wherein the cutaway section creates a sharpened edge adjacent to the keyway and the cutaway section is configured to cut into the cable tie when the first element is rotated relative to the second element to cause the first and second elements to move apart.

15. A cable tie cutoff tool for cutting a cable tie consisting essentially of first and second elements which are injection molded, the first element comprising external threads and the second element comprising internal threads which mate with the external threads of the first element;

the first element further comprising a through hole and internal threads and a keyway in the internal threads of the first element, the internal threads being in a right hand direction and the external threads of the first element being in a left hand direction;

the second element further comprising a through hole with a blade at one end of the through hole of the first element and the through hole of the second element being threaded with internal threads which mate the external threads of the first element.

16. The tool of claim 15 wherein the internal threads of the first element further comprise a cutaway section adjacent the keyway, the cutaway section configured to engage the cable tie to cause the internal threads of the first element to cut into the cable tie when the first element is rotated relative to the second element to cause the first and second elements to move apart.

17. The tool of claim 15 wherein the blade of the second element includes two blade sections on opposite sides of an end opening of the second element.

18. The tool of claim 17 wherein each blade section is positioned opposite a non-blade section such that rotation of the first section in a first direction engages the blade with a work piece extending through the end opening and rotation of the first section in a second direction causes the work piece to contact the non-blade sections without being cut.

* * * * *